US005556063A

United States Patent [19]

Boyd

[11] Patent Number: 5,556,063

[45] Date of Patent: Sep. 17, 1996

[54] TRASH BAG RETAINING BAND

[76] Inventor: Billy S. Boyd, R.D. #2 Box 290, Brogue, Pa. 17309

[21] Appl. No.: 329,638

[22] Filed: Oct. 26, 1994

[51] Int. Cl.[6] ..... B65B 67/00

[52] U.S. Cl. ..... 248/99; 24/17 B

[58] Field of Search ..... 248/99, 101, 95, 248/97, 154, 312, 312.1; 24/16 PB, 30.5 R, 30.5 L, 17 B, 17 AP; D34/10

[56] References Cited

U.S. PATENT DOCUMENTS

| | | | |
|---|---|---|---|
| 3,614,041 | 10/1971 | Koger | 248/101 X |
| 3,779,419 | 12/1973 | Heitz | 248/99 X |
| 3,927,445 | 12/1975 | Pavlish | 248/95 X |
| 4,287,701 | 9/1981 | Washington | 248/99 X |
| 4,338,979 | 7/1982 | Dow | 248/101 X |
| 4,378,924 | 4/1983 | Christensen | 248/101 |
| 4,738,478 | 4/1988 | Bean, Jr. | 248/99 X |
| 5,107,564 | 4/1992 | Grumbles | 248/101 X |
| 5,150,810 | 9/1992 | Loebbert | 248/99 X |

FOREIGN PATENT DOCUMENTS

| | | | |
|---|---|---|---|
| 2197288 | 5/1988 | United Kingdom | 248/95 |

*Primary Examiner*—Karen J. Chotkowski

[57] ABSTRACT

A trash bag retaining band comprising a ring formed of an elastic material sufficiently expandable for allowing a trash can to be inserted therein and sufficiently retractable for frictionally gripping an inserted trash can and with the ring having an exterior surface, an interior surface, a top edge and a bottom edge interconnecting the surfaces, and a handle mechanism coupled to and extended outwards therefrom for allowing a user a firm grip.

1 Claim, 4 Drawing Sheets

TRASH BAG RETAINING BAND

BACKGROUND OF THE INVENTION

1. Field of the Invention

The present invention relates to a trash bag retaining band and more particularly pertains to holding a trash bag in a secured position in a trash can for filling with trash and further preventing over-filling of the trash bag with a trash bag retaining band.

2. Description of the Prior Art

The use of waste container reciprocal fasteners is known in the prior art. More specifically, waste container reciprocal fasteners heretofore devised and utilized for the purpose of holding a trash bag in a secured position for filling are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,815,778 to Martin discloses a trash bag container. U.S. Pat. No. 4,946,118 to Hastings discloses a trash bag retainer. U.S. Pat. No. 5,040,902 to Eaton et al. discloses a trash bag closure system. U.S. Pat. No. 5,100,087 to Ashby discloses a fastening device for container liners. U.S. Pat. No. 5,149,028 to Blackaby et al. discloses a lawn bag support frame.

While these devices fulfill their respective, particular objective and requirements, the aforementioned patents do not describe a trash bag retaining band that allows a trash bag to be placed in a secured position in a trash can for filling with trash and further prevents its over-filling.

In this respect, the trash bag retaining band according to the present invention substantially departs from the conventional concepts and designs of the prior art, and in doing so provides an apparatus primarily developed for the purpose of holding a trash bag in a secured position in a trash can for filling with trash and further preventing over-filling of the trash bag.

Therefore, it can be appreciated that there exists a continuing need for new and improved trash bag retaining band which can be used for holding a trash bag in a secured position in a trash can for filling with trash and further preventing over-filling of the trash bag. In this regard, the present invention substantially fulfills this need.

SUMMARY OF THE INVENTION

In the view of the foregoing disadvantages inherent in the known types of waste container reciprocal fasteners now present in the prior art, the present invention provides an improved trash bag retaining band. As such, the general purpose of the present invention, which will be described subsequently in greater detail, is to provide a new and improved trash bag retaining band and method which has all the advantages of the prior art and none of the disadvantages.

To attain this, the present invention essentially comprises a ring formed of an elastic polymeric material. The ring is sufficiently expandable for allowing a trash can to be inserted therein and sufficiently retractable for frictionally gripping an inserted trash can. The ring has an exterior surface, an interior surface, and a top edge and a bottom edge interconnecting the surfaces. A plurality of equally-spaced annular grooves are formed on with ring with each groove positioned essentially perpendicular to the circumferential extent of the ring such that the grooves thereby create an interconnected linkage of upstanding and generally rectangular tabs. A pair of diametrically positioned tabs of the linkage each have a generally rectangular planar horizontal piece extended perpendicularly outwards from a central extent of the exterior surface to thereby create a tri-tab. Each tri-tab has a generally T-shaped vertical cross-section. Each tri-tab serves as a handle for allowing a user a firm grip for expanding the ring.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved trash bag retaining band which has all the advantages of the prior art waste container reciprocal fasteners and none of the disadvantages.

It is another object of the present invention to provide a new and improved trash bag retaining band which may be easily and efficiently manufactured and marketed.

It is a further object of the present invention to provide a new and improved trash bag retaining band which is of durable and reliable construction.

An even further object of the present invention is to provide a new and improved trash bag retaining band which is susceptible of a low cost of manufacture with regard to both materials and labor, and which accordingly is then susceptible of low prices of sale to the consuming public, thereby making such a trash bag retaining band economically available to the buying public.

Still yet another object of the present invention is to provide a new and improved trash bag retaining band which provides in the apparatuses and methods of the prior art some of the advantages thereof, while simultaneously overcoming some of the disadvantages normally associated therewith.

Even still another object of the present invention is to provide a new and improved trash bag retaining band for holding a trash bag in a secured position in a trash can for filling with trash and further preventing over-filling of the trash bag.

Lastly, it is an object of the present invention to provide a new and improved trash bag retaining band comprising a ring formed of an elastic material sufficiently expandable for allowing a trash can to be inserted therein and sufficiently retractable for frictionally gripping an inserted trash can with the ring having an exterior surface, an interior surface, a top edge and a bottom edge interconnecting the surfaces, and handle means coupled to and extended outwards therefrom for allowing a user a firm grip.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 4:
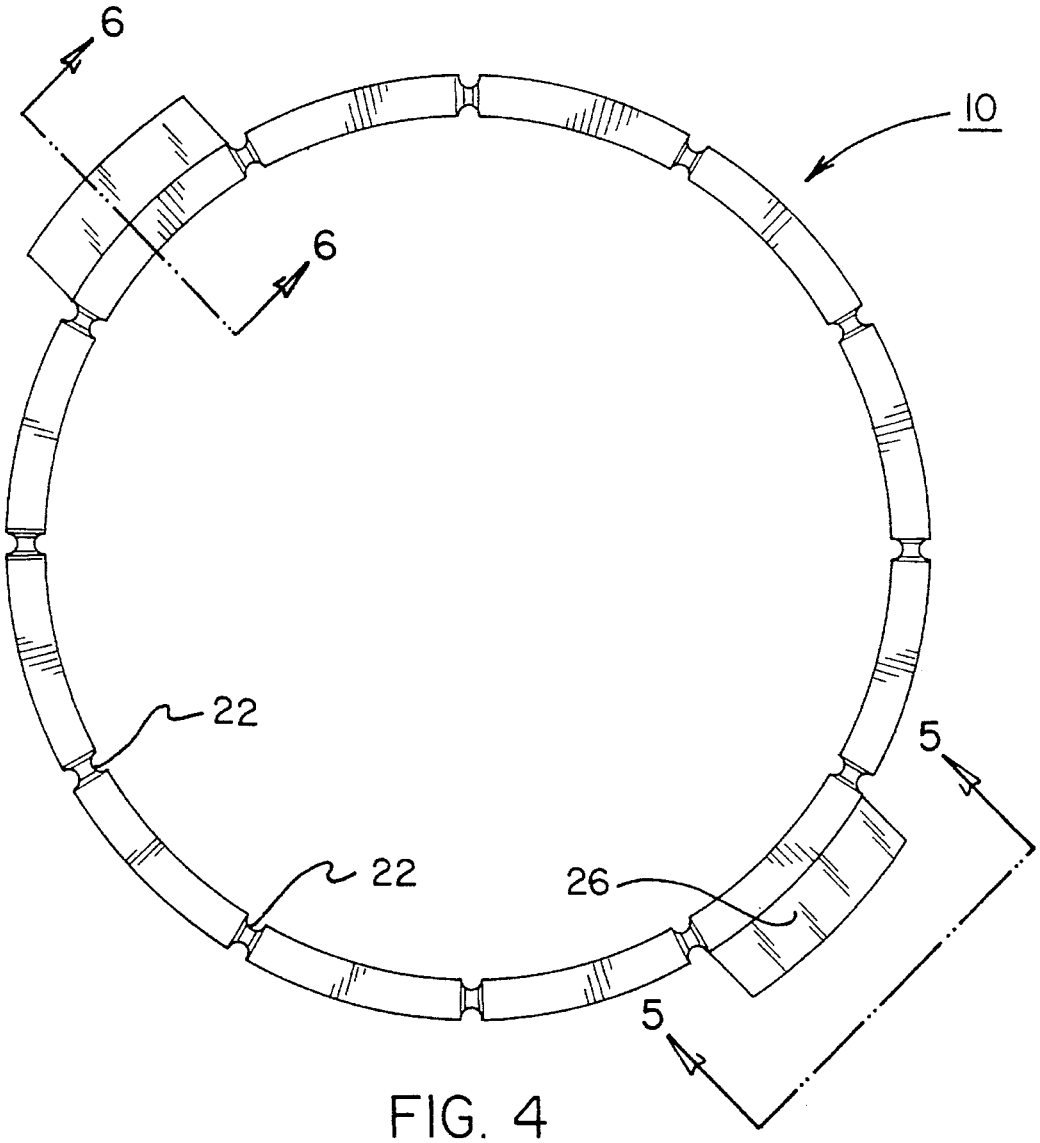
FIG. 4 is a plan view of the preferred embodiment constructed in accordance with the principles of the present invention.
Figure 5:
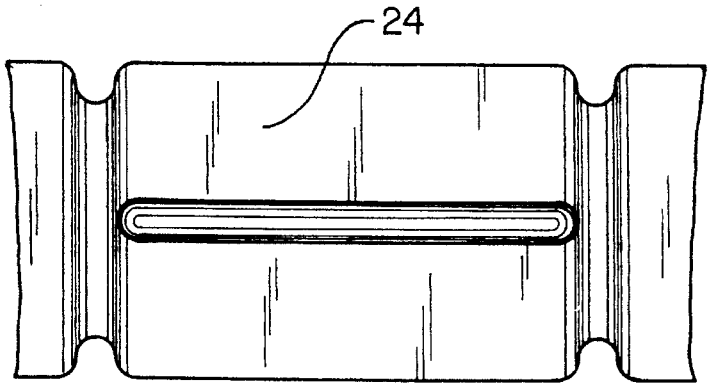
FIG. 5 is a side elevational view of the preferred embodiment taken along the line 5—5 of FIG. 4.
Figure 6:
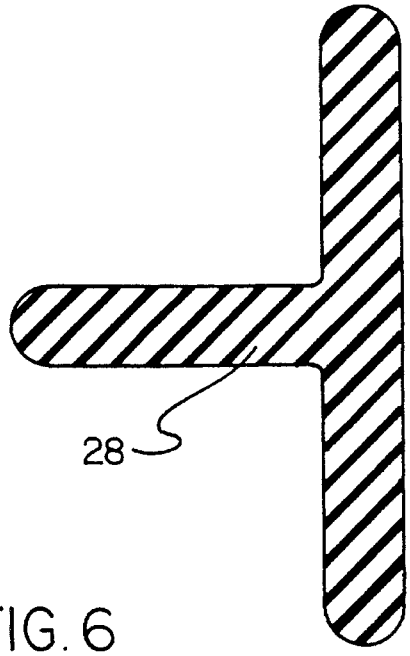
FIG. 6 is a cross-sectional view of the preferred embodiment taken along the line 6—6 of FIG. 6.

With reference now to the drawings, and in particular, to FIG. 4 thereof, the preferred embodiment of the new and improved trash bag retaining band embodying the principles and concepts of the present invention and generally designated by the reference number 10 will be described.

Specifically, the present invention includes a ring 12. The ring is formed of an elastic polymeric material such as rubber. The ring is sufficiently expandable for allowing a trash can with an associated trash bag to be inserted therein. The ring is also sufficiently retractable for efficiently gripping an inserted trash bag and an associated trash can in a fixed position for allowing the trash bag to be filled with trash. The ring has an exterior surface 14, and interior surface 16, and a top edge 18 and a bottom edge 20 interconnecting the surfaces. The ring also includes a plurality of equally-spaced annular-shaped grooves 22 formed thereon. Each groove is formed essentially perpendicular to the circumferential extent of the ring. In these positions, the grooves thereby create an interconnected linkage of upstanding and generally rectangular tabs 24. Each tab has an exterior surface and an interior surface. A pair of diametrically positioned tabs of the linkage each further have a generally rectangular planar horizontal piece 26 extended perpendicularly outwards from a central extent of the exterior surface of the tab. This horizontal piece in combination with the tab itself creates a tri-tab 28. This tri-tab has a generally t-shaped vertical cross-section. Each tri-tab serves as a handle for allowing a user a firm grip for expanding the ring to placement of a trash can and associated trash bag therein.

Figure 1:
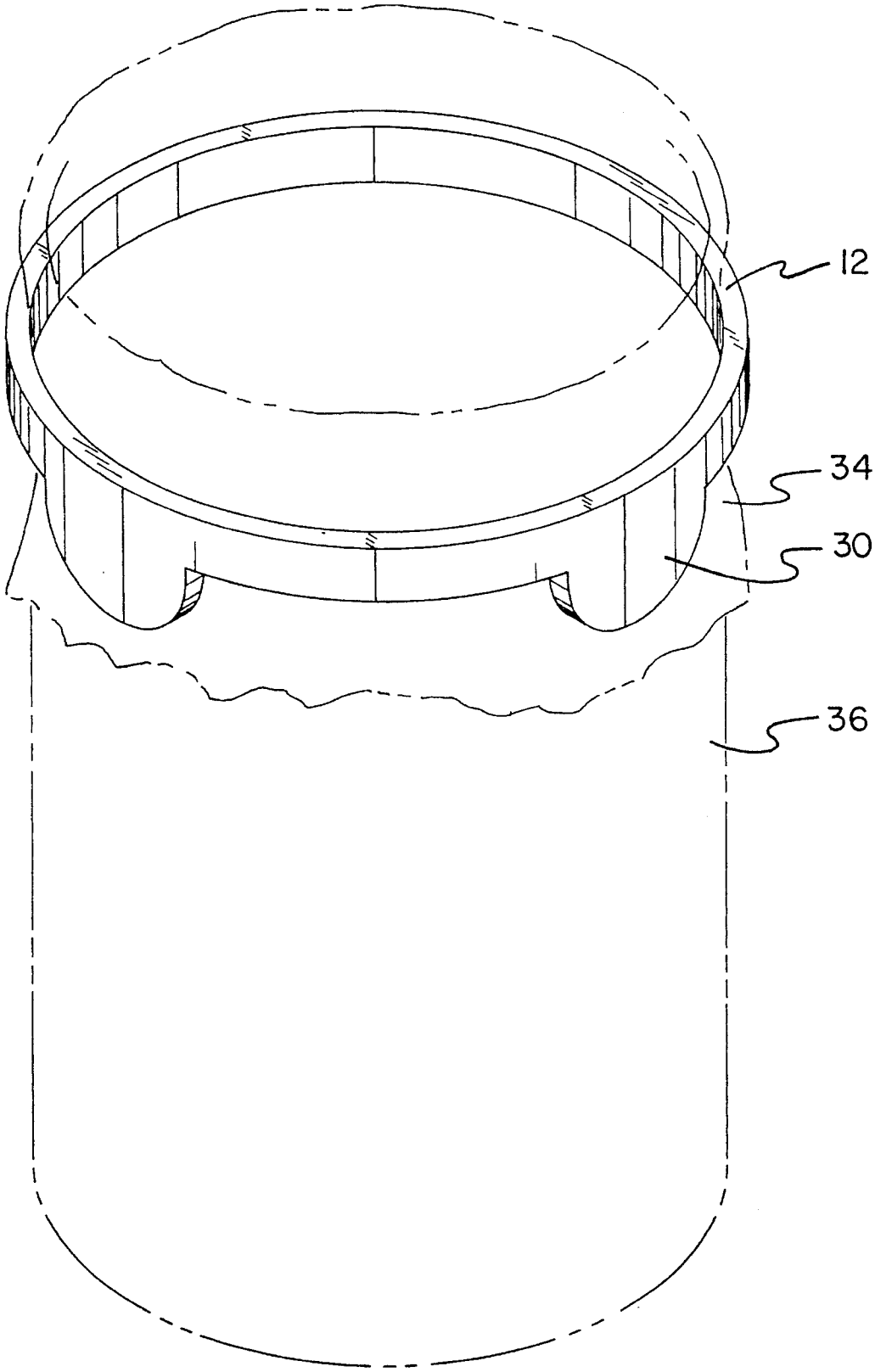
FIG. 1 is a perspective view of an embodiment of the present invention holding a trash bag in a trash can.
Figure 2:
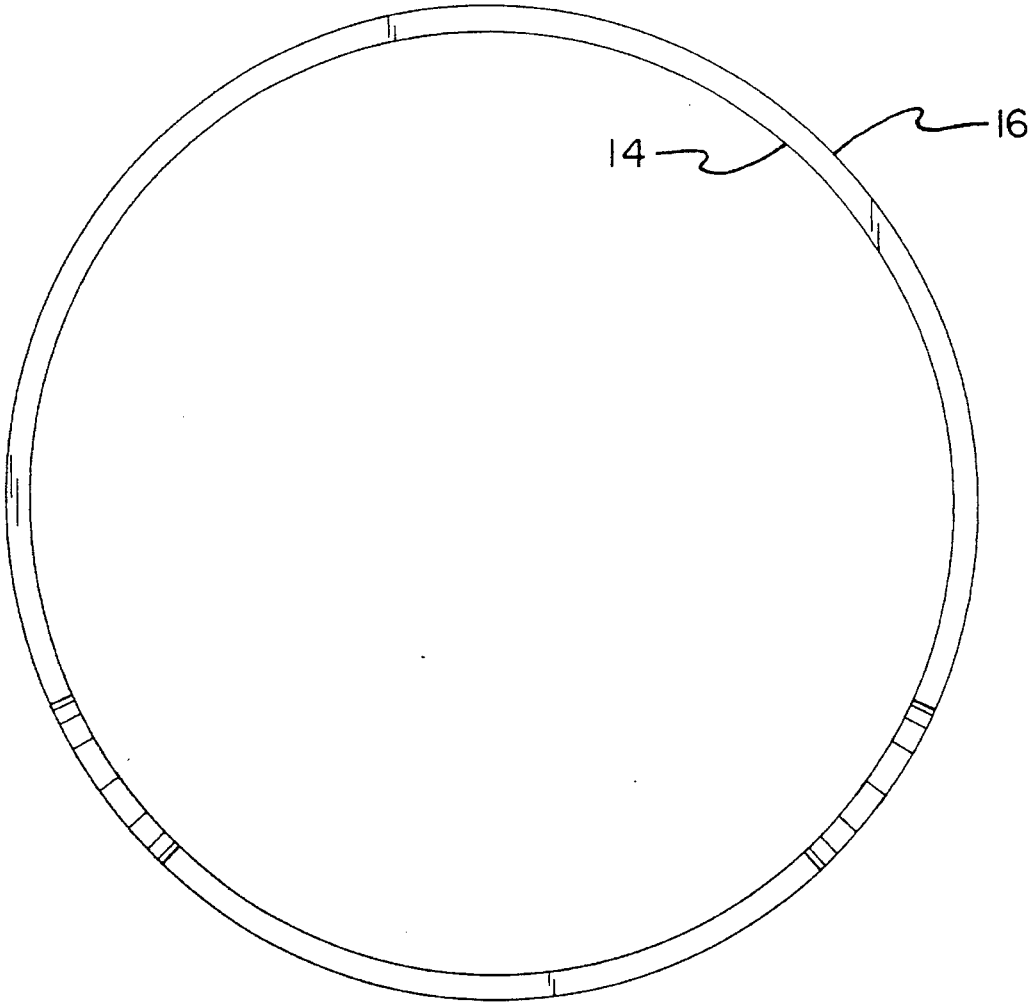
FIG. 2 s a plan view of the embodiment depicted in FIG. 1.
Figure 3:
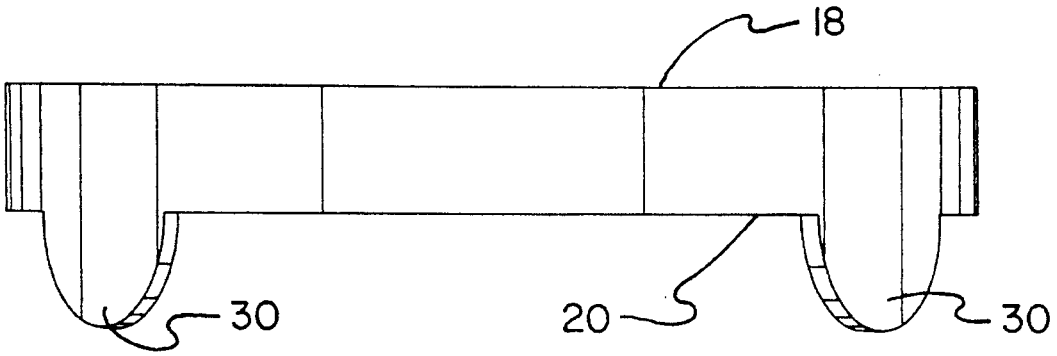
FIG. 3 is a side elevational view of the embodiment depicted in FIG. 1.

A second embodiment of the present invention is shown in FIG. 1 and includes a different type of handle mechanism. In this embodiment, a pair of semi-circular shaped and spaced tabs 30 are extended downwards from the bottom edge of the ring. These tabs are pulled outwards for expanding the ring for placement of a trash can and associated trash bag therein and pulled upwards and outwards for releasing the ring from a trash can and trash bag. These tabs formed as an integral part of the ring.

Figure 7:
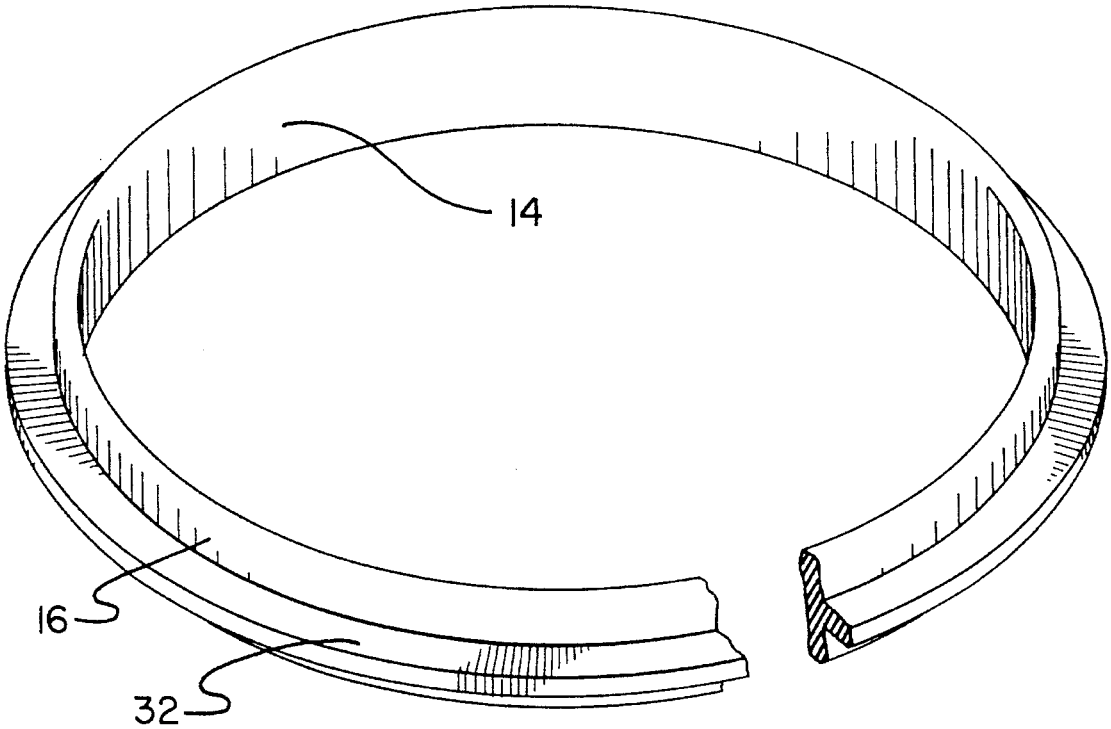
FIG. 7 is a perspective view of yet another embodiment of the present invention.

A third embodiment of the present invention is shown in FIG. 7. This embodiment also includes a different type of handle mechanism. In this embodiment, another ring 32 in combination with the first ring 12 is used as the handle. Ring 32 is coupled to and extended radially outwards from the exterior surface of the first ring 12. Thus, this handle allows the user the capability to grip the ring at desired locations therearound for allowing its expansion. Thus, the annular handle in this embodiment affords a user increased orientational capability for gripping and manipulating the ring that is not afforded by the preferred or second embodiment.

The present invention is an accessory designed for use in conjunction with a trash bag and trash can, which will hold and installed bag in place while also preventing overfilling of the bag. The present invention is formed of a hoop-band of elastic which is just slightly smaller than the outside diameter of the trash can. The present invention is designed and used to hold a trash bag in a position within a standard-sized household or industrial trash can. Note that no special trash cans or trash bags are needed. The preferred embodiment of the present invention has a circular shape that is flat with the exception of smaller diameter rings or grooves that run along the ring or band. The small diameter grooves cause the band to have an appearance similar to a string of links which have been flattened out. These grooves tend to flatten out when stretched, which will grip the trash bag when tension is released to ensure more holding power. The two tri-tabs make grasping and manipulating the present invention easier. The preferred embodiment also includes tri-tabs that serve as handles. The tri-tabs are evenly spaced and formed on the band. The present invention has two basic functions. The first function is to hold the trash bag in position to preclude its slipping into a trash can while the trash can is being filled. The second function is to keep a portion of the trash bag from being filled so that there is room to close the trash bag when filled and allow its ready removal from the trash can.

The present invention is readily put into operation. First, a trash bag is placed into a trash can so that approximately 4–5 inches of the bag drape over the outside rim of the can. This is the traditional method used by most everyone. Next, the present invention is grasped by both hands through the use of the tri-tabs. Now, a portion of the present invention that is nearest to the user is then placed under the rim of the can. The portion of the band that is furthest from the user is then stretched over the top of the can and under its rim. Now, the tri-tabs are released. The present invention is now properly installed. As articles and trash are placed into the bag and can, it will not be necessary to hold the bag open with one hand so that it does not fold over upon itself. When the bag is removed from the can, the section which was previously draped over the can will obviously be free of contents. Hence, this section will always be available for use for tying, since the bag cannot be over-filled retained with the present invention in the aforementioned matter. The alternative when not utilizing the present invention, is of course, the messy and tedious job of transferring trash from an overfilled bag to a second bag before it can be tied. When the trash bag is full, the present invention is grasped by the tri-tabs, one with each hand. The present invention now is pulled forward and up over the rim of the can, thereby releasing its grip of the can and allowing the trash bag to be removed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A trash bag retaining band for holding a trash bag in a secured position in a trash can for filling with trash and further preventing over-filling of the trash bag comprising:

an integral ring formed of an elastic polymeric material sufficiently expandable and having a diameter smaller than an outside diameter of the trash can for allowing the standard-sized trash can to be inserted therein and sufficiently retractable for frictionally gripping the inserted standard-sized trash can; the ring having an exterior surface; an interior surface; a top edge and a bottom edge interconnecting the surfaces; a plurality of equally-spaced annular grooves integrally formed on the ring with each groove positioned essentially perpendicular to the circumferential extent of the ring such that the grooves thereby create an interconnected linkage of upstanding and rectangular tabs, the annular grooves adapted to flatten out when stretched and grip the trash bag when tension is released thereby ensuring more holding power; and a pair of diametrically positioned integral tabs of the linkage each having a generally rectangular planar horizontal piece extended perpendicularly outwards from a central extent of its exterior surface to thereby create a tri-tab having a generally T-shaped vertical cross-section and with each tri-tab serving as a handle for allowing a user a firm grip for expanding the ring.

* * * * *